US007011068B2

(12) United States Patent
Yamagata et al.

(10) Patent No.: US 7,011,068 B2
(45) Date of Patent: Mar. 14, 2006

(54) ACCESSORY MOUNTING STRUCTURE FOR INTERNAL COMBUSTION ENGINE

(75) Inventors: Takayuki Yamagata, Saitama (JP); Yoshiaki Koyama, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/286,808

(22) Filed: Nov. 4, 2002

(65) Prior Publication Data

US 2003/0084865 A1 May 8, 2003

(30) Foreign Application Priority Data

Nov. 7, 2001 (JP) ..... 2001-341482

(51) Int. Cl.
*F02F 7/00* (2006.01)

(52) U.S. Cl. ..... 123/195 A; 123/195 R
(58) Field of Classification Search ..... 123/195 A, 123/195 R See application file for complete search history.

(56) References Cited

U.S. PATENT DOCUMENTS

| | | | | |
|---|---|---|---|---|
| 4,947,812 A | * | 8/1990 | Inoue et al. | 123/193.2 |
| 5,125,376 A | * | 6/1992 | Williams et al. | 123/195 A |
| 6,101,994 A | * | 8/2000 | Ichikawa | 123/195 R |
| 6,244,239 B1 | * | 6/2001 | Sisco et al. | 123/198 R |

FOREIGN PATENT DOCUMENTS

| | | | |
|---|---|---|---|
| GB | 2182390 A | * | 5/1987 |
| JP | 63173811 A | * | 7/1988 |
| JP | 2001-193473 | | 7/2001 |

* cited by examiner

*Primary Examiner*—Thomas Denion
*Assistant Examiner*—Zelalem Eshete
(74) *Attorney, Agent, or Firm*—Armstrong, Kratz, Quintos, Hanson & Brooks, LLP

(57) ABSTRACT

An accessory mounting structure has an accessory bracket holding accessories thereon and attached to the engine body of an internal combustion engine, to provide a shortest possible overall length. The accessory mounting structure includes an end part, with respect to a direction parallel to a crankshaft, of the engine body, provided with a passage, a part of the engine body, provided with a recess extending along the passage, and the accessory bracket partly sunk in the recess and fastened to the engine body. At least one accessory, such as an automatic tensioning device is held on the accessory bracket.

12 Claims, 9 Drawing Sheets

ACCESSORY MOUNTING STRUCTURE FOR INTERNAL COMBUSTION ENGINE

BACKGROUND OF THE INVENTION

1. Field of the Invention

The present invention relates to an accessory mounting structure for an internal combustion engine, such as an automotive internal combustion engine.

2. Description of the Related Art

In an internal combustion engine disclosed in JP-A No. 193473/2001 provided with accessories arranged on one side of an engine body along a crankshaft, an oil pump body is attached to a side surface of the engine body, an accessory bracket is attached to the oil pump body, and accessories are held on the accessory bracket.

Because the accessory bracket is attached to the oil pump body which in turn is attached to the engine body, the overall length of the internal combustion engine increases by a length corresponding to the width of the oil pump body.

On the other hand, the thickness of the oil pump body must be increased to form a rigid accessory mounting seat, which further increases the overall length of the internal combustion engine.

SUMMARY OF THE INVENTION

The present invention has been made in view of the foregoing problems and it is therefore an object of the present invention to provide an accessory mounting structure for an internal combustion engine having an engine body and an accessory bracket holding accessories and attached to the engine body, capable of making the internal combustion engine to be formed in the shortest possible overall length.

According to one aspect of the present invention, an accessory mounting structure for an internal combustion engine comprises: an end part, with respect to a direction parallel to a crankshaft, of an engine body, provided with a passage; a part of the engine body, provided with a recess extending along the passage; and an accessory bracket partly sunk in the recess and fastened to the engine body, and capable of holding at least one accessory thereon.

Because the accessory bracket is directly fastened to the engine body with a part thereof sunk in the recess extending along the passage, the accessory bracket is partly sunk in the engine body, so that the internal combustion engine provided with the accessory held on the accessory bracket has a comparatively short overall length.

In the accessory mounting structure according to the present invention, the accessory bracket partly sunk in the recess may have an accessory mounting part, and the accessory mounting part may be provided with a reinforcing rib.

The accessory support part reinforced with the reinforcing rib enables forming the internal combustion engine to be formed in a short overall length, is capable of stably holding the accessory, and increases the rigidity of the accessory bracket.

In the accessory mounting structure according to the present invention, the reinforcing rib may connect at least one of attaching parts of the accessory bracket to be fastened to the engine body to fasten the accessory bracket to the engine body, and the accessory support part.

Because at least one of the attaching parts to be fastened to the engine body to attach the accessory bracket to the engine body, and the accessory support part are connected by the reinforcing rib, the vibration of the accessory bracket caused by the vibration of the internal combustion engine can be suppressed, the accessory can be further stably held, fastening strength fastening the accessory bracket to the engine body can be enhanced.

In the accessory mounting structure according to the present invention, the accessory held by the accessory support structure may be, for example, an automatic tensioning device.

Because the automatic tensioning device is held on the accessory bracket partly sunk in the engine body and rigidly fastened to the engine body, the automatic tensioning device continuously subjected to a reaction force can be firmly held, belts for driving the accessory can be disposed close to the engine body, and hence the internal combustion engine have a in compact construction.

In the accessory mounting structure according to the present invention, it is preferable that the accessory mounting part of the accessory bracket is a convex part protruding toward the engine body, and the convex part is placed in the recess formed in the engine body.

In the accessory mounting structure according to the present invention, it is preferable that the accessory mounting part is provided with an accessory mounting seat on its side surface. The accessory bracket has an attaching part to be attached to the engine body, and the attaching part of the accessory bracket is fastened to the engine body by fastening means. Preferably, the back surface of the attaching part to be fastened to the engine body is flat, and a front surface opposite the back surface of the attaching part is provided with a recess. The accessory bracket may be provided with holding arms for holding another accessory.

When the reinforcing rib is formed behind the accessory support part, the rigidity of the accessory bracket is further continuously loaded can be firmly held on the accessory support part.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
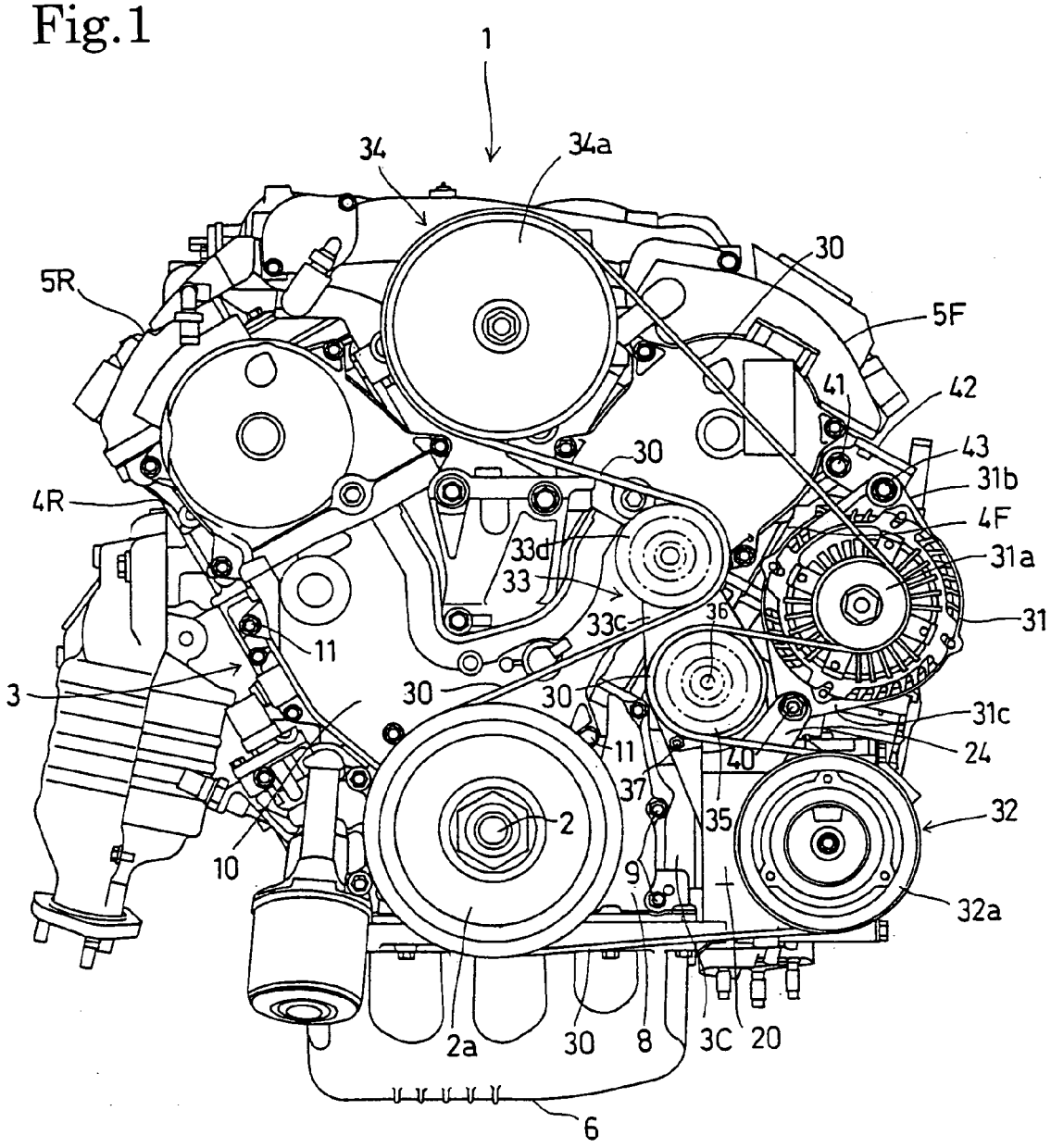
FIG. 1 is a side elevation of an internal combustion engine provided with an accessory mounting structure in a preferred embodiment according to the present invention taken from the right side of the internal combustion engine.

Referring to FIG. 1 showing an internal combustion engine 1 including an accessory mounting structure in a preferred embodiment according to the present invention, the internal combustion engine is a four-stroke-cycle V-6 internal combustion engine provided with two cylinder banks of three cylinders each, namely, a front cylinder bank 3F and a rear cylinder bank 3R, set at an angle. The internal combustion engine 1 is mounted laterally on the body of a vehicle with its crankshaft 2 extended laterally in a horizontal position, the three cylinders of the front cylinder bank 3F tilted forward and the three cylinders of the rear cylinder bank 3R tilted rearward.

Figure 2:
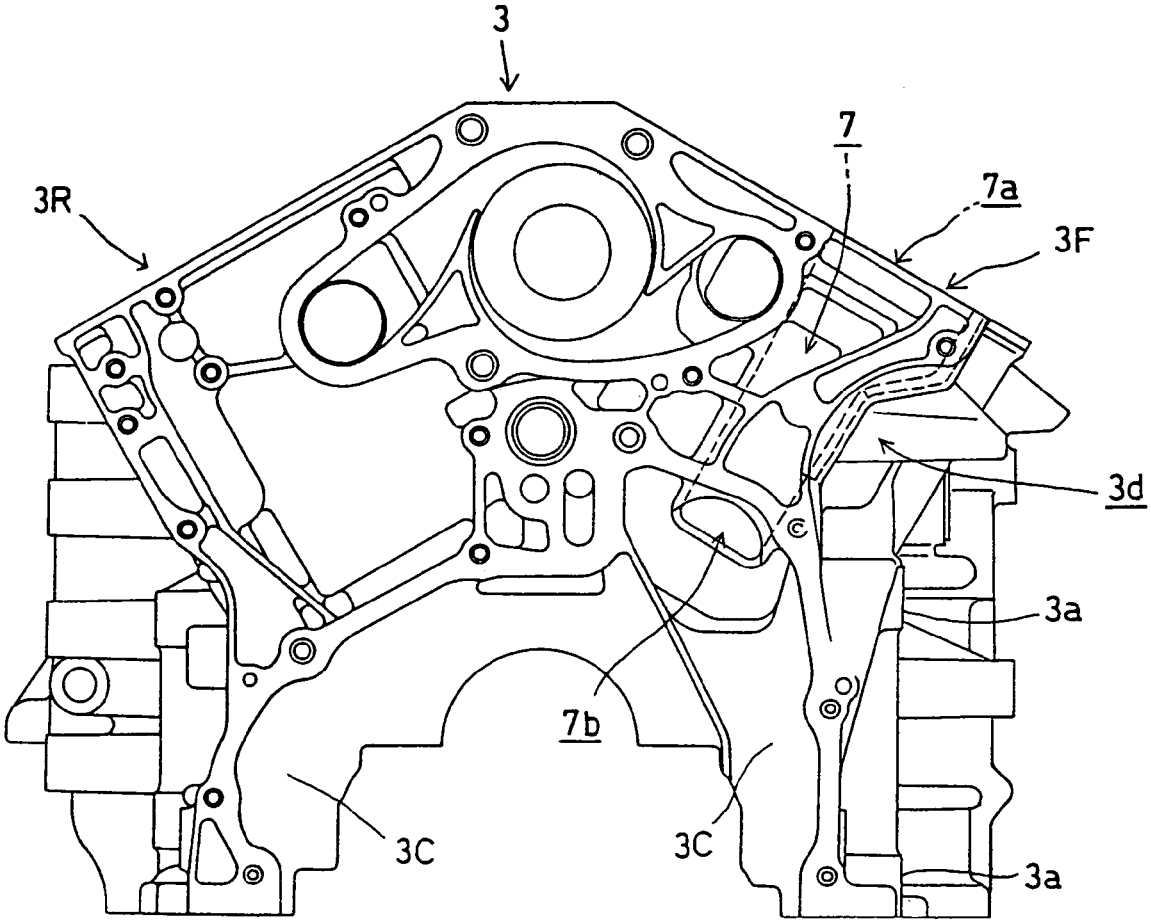
FIG. 2 is a side elevation of a cylinder block taken from the right side of the cylinder block.
Figure 3:
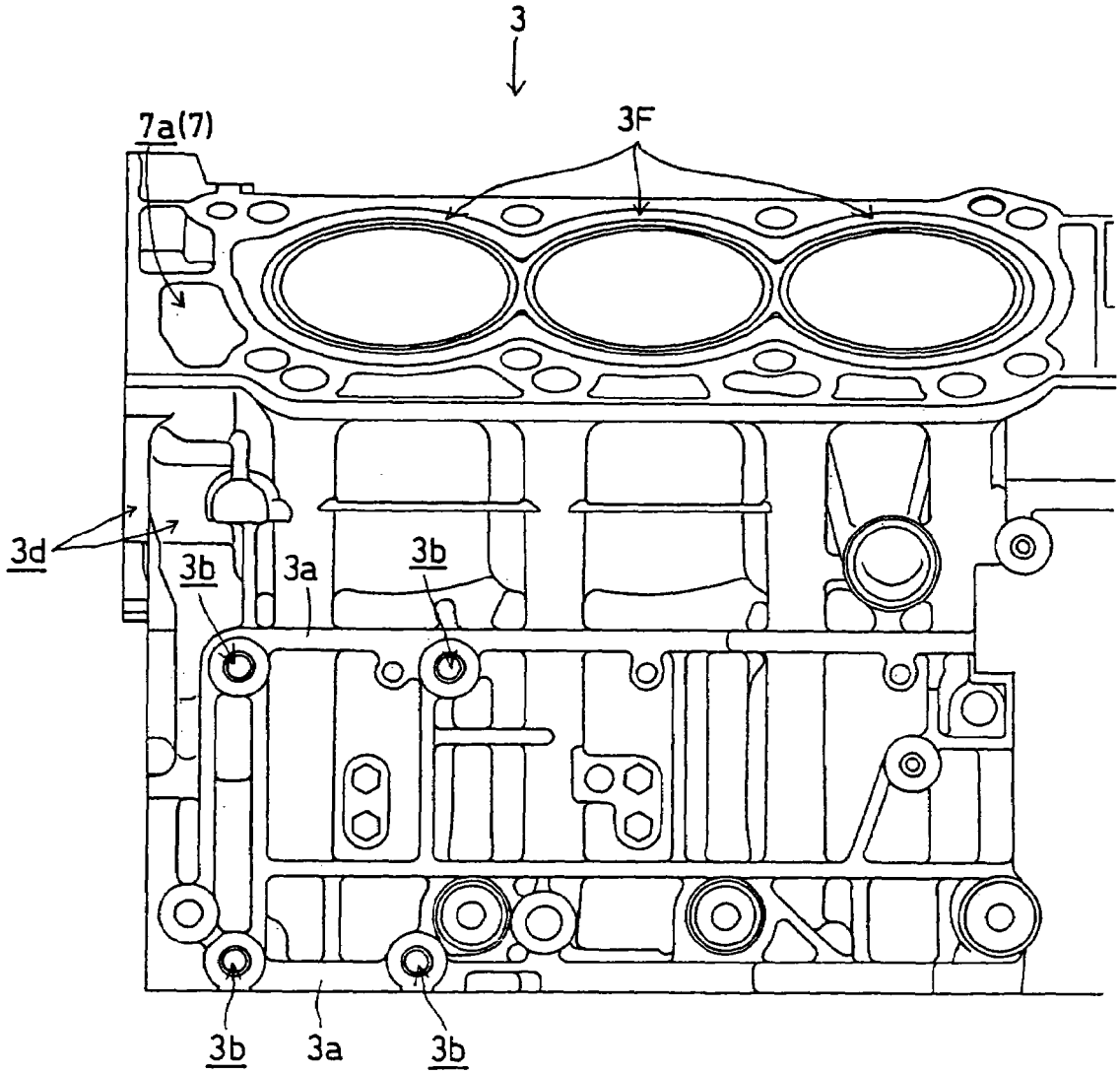
FIG. 3 is a front elevation of the cylinder block shown in FIG. 2.

As shown in FIGS. 2 and 3, the front cylinder bank 3F and the rear cylinder bank 3R are set at an angle in the shape of the letter V, and a crankcase 3C is formed under the middle joining part joining the front cylinder bank 3F and the rear cylinder bank 3R. The front cylinder bank 3F and the rear cylinder bank 3R are offset laterally relative to each other for the proper arrangement of connecting rods; the front cylinder bank 3F is offset to the left relative to the rear cylinder bank 3R. In this specification, the terms 'right', 'left', 'front', 'rear' and such for modifying directions and positions correspond to the right, the left, the front and the rear and such of a vehicle mounted with the internal combustion engine 1, respectively.

A blowby gas passage 7 is formed in a right end part of the front cylinder bank 3F offset to the left. The blowby gas passage 7 extends along cylinder bores formed in the front cylinder bank 3F in a part of the front cylinder bank 3F between the right cylinder and the right end of the front cylinder bank 3F. The blowby gas passage 7 has an upper opening 7*a* opening in the upper joining surface of the cylinder block 3 and a lower opening 7*b* opening into a crank chamber.

As shown in FIG. 1, a cylinder head 4F and a cylinder head cover 5*f* are fastened in that order to the front cylinder bank 3F of the cylinder block 3, and a cylinder head 4R and a cylinder head cover 5R are fastened in that order to the rear cylinder bank 3R of the cylinder block 3. An oil pan 6 is fastened to the lower end of the cylinder block 3.

As shown in FIG. 1, an oil pump body 8 is fastened to the right end surface of the cylinder block 3 with bolts 9 so as to surround a crankshaft 2. A V-shaped timing belt cover 10 is fastened to the right end surface of the cylinder block 3 with bolts 11 so as to cover the oil pump body 8 partly and to extend along the end surface of the front cylinder bank 3F and the rear cylinder bank 3R.

Timing belts are extended along the right end surface of the cylinder block 3 in a timing belt chamber covered with the timing belt cover 11 to transmit the rotation of the crankshaft 2 to front and rear valve mechanisms.

An accessory bracket 20 is fastened to a right part of the front surface of a crankcase part 3C of the cylinder block 3. An alternator 31 and an air compressor 32 are held on the accessory bracket 20 so as to protrude forward. The alternator 31 is disposed above the air compressor 32. An automatic tensioning device 33 is disposed between the alternator 31 and the air compressor 32 so as to face rightward.

The automatic tensioning device 33 includes a swing arm 33*c* having a base end pivotally supported on the cylinder block 3, an idler pulley 33*d* supported for rotation on the free end of the swing arm 33*c*, and an idler pulley 35 supported for rotation on the base end of the swing arm 33*c* coaxially with the turning axis of the swing arm 33*c*.

The alternator 31 has an input shaft projecting to the right, and a generator pulley 31*a* is mounted on the input shaft. The air compressor 32 has an input shaft projecting to the right, and an air compressor pulley 32*a* is mounted on the input shaft.

A drive pulley 2*a* is mounted on a right end part of the crankshaft 2 projecting to the right from the timing belt cover 10. A power-steering pump 34 is disposed between the front cylinder head cover 5F and the rear cylinder head cover 5R. A pump pulley 34*a* is mounted on the input shaft of the power-steering pump 34.

The two pulleys 31*a* and 32*a* mounted respectively on the shafts of the alternator 31 and the air compressor 32 held on the accessory bracket 20, the pulleys 33*d* and 35 of the automatic tensioning device 33, the pulley 34*a* mounted on the power-steering pump 34, and the pulley 2*a* mounted on the crankshaft 2 are arranged in a plane parallel to the right end surface of the internal combustion engine 1. A single endless accessory driving belt 30 is extended around those pulleys 31*a*, 32*a*, 33*d*, 35, 34*a* and 2*a* to transmit the rotation of the crankshaft 2 to those accessories 31, 32, 33 and 34.

As shown in FIG. 1, the endless accessory driving belt 30 is extended around the drive pulley 2*a*, the idler pulley 33*d*, the pump pulley 34*a*, the generator pulley 31*a*, the idler pulley 35 and the air compressor pulley 32*a*. The idler pulley 33*d* of the automatic tensioning device 33 is pressed against a part of the endless accessory driving belt 30 between the drive pulley 2*a* and the pump pulley 34*a* to tension the endless accessory driving belt 30 properly.

Figure 4:
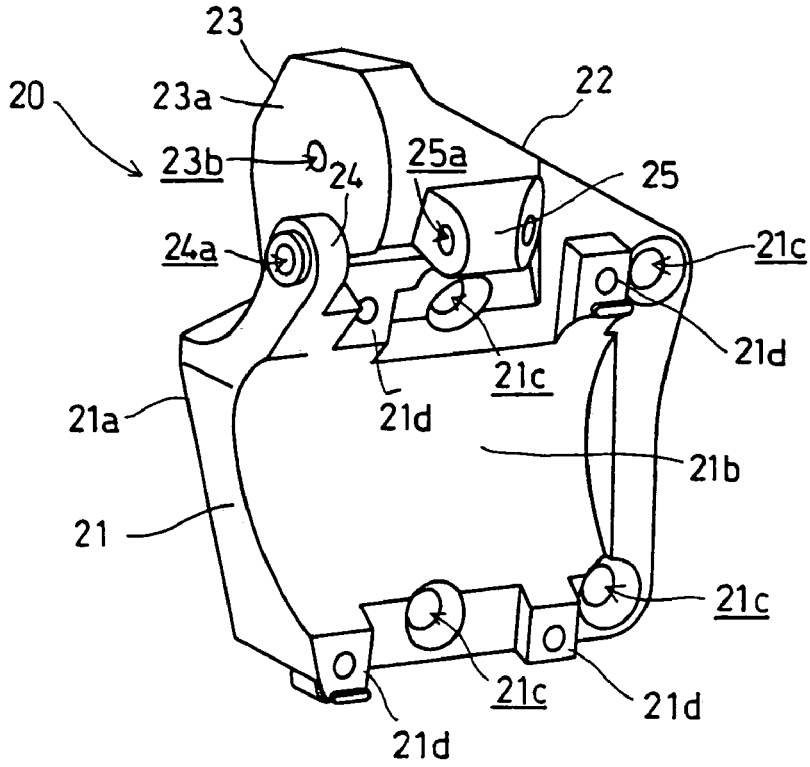
FIG. 4 is a perspective view of an accessory block.
Figure 5:
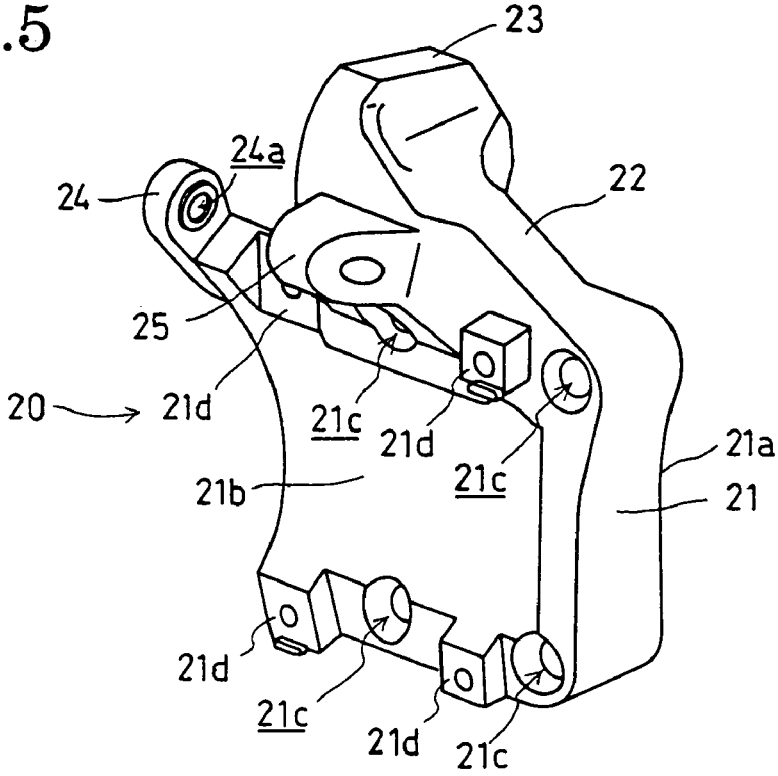
FIG. 5 is another perspective view of the accessory block shown in FIG. 4.

FIGS. 4 and 5 shows the accessory bracket 20 holding the three accessories, namely, the alternator 31, the air compressor 32 and the automatic tensioning device 33, as attached to the cylinder block 3 of the internal combustion engine 1 mounted on the body of the automobile in perspective views taken obliquely from the front side of the internal combustion engine 1.

The accessory bracket 20 has an attaching part 21 to be attached to the cylinder block 3. The attaching part 21 is a substantially rectangular plate having a flat inner surface 21*a* and an outer surface 21*b* provided with a cylindrical recess. The surface of the cylindrical recess of the outer surface 21*b* is a part of a cylinder having a horizontal axis. Four counterbored attaching holes 21*c* are formed in upper right and left and lower right and left parts of the recess. Mounting bosses 21*d* provided with threaded holes each are formed on the right-hand side of the four mounting holes 21*c*, respectively.

A reinforcing rib 22 rises from the left end (right end as viewed in FIGS. 4 and 5) of the upper side of the mounting part 21. A left end part of the reinforcing rib 22 is extended greatly rearward to form an accessory mounting part 23. The accessory mounting part 23 has a right vertical surface serving as an accessory mounting surface 23*a*.

Figure 7:
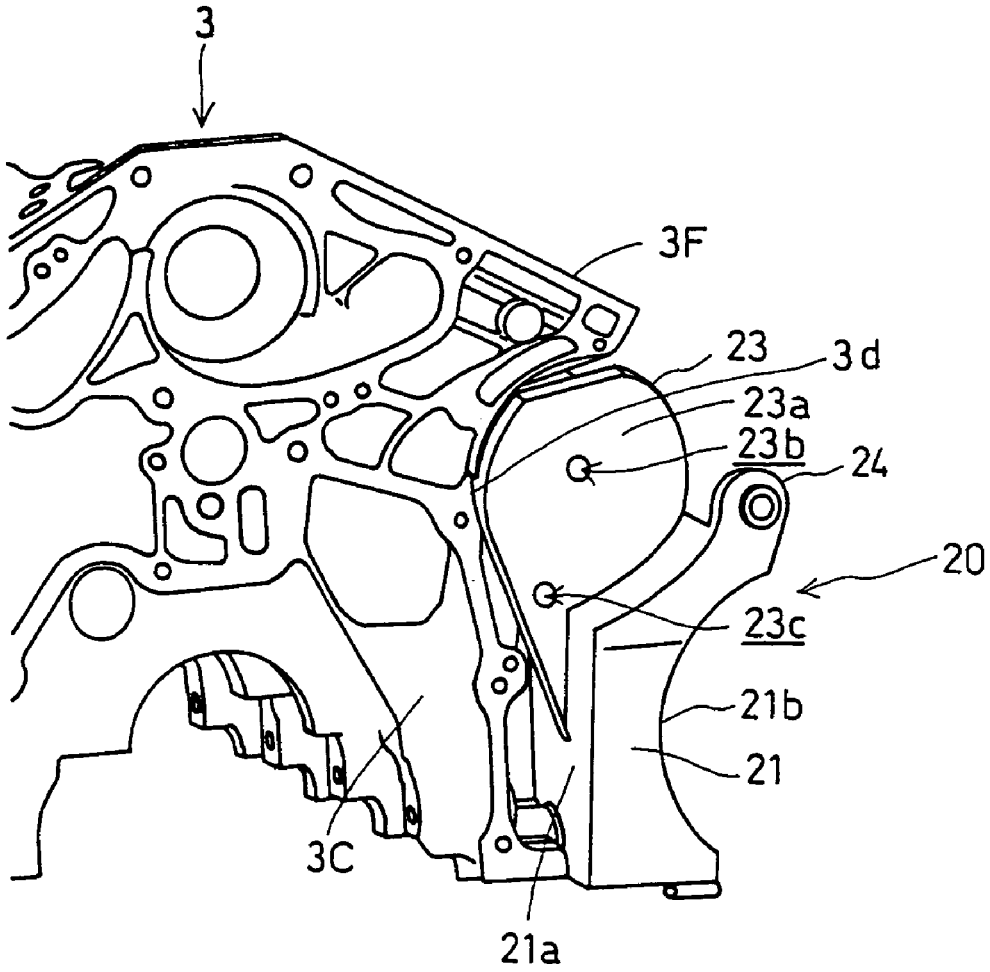
FIG. 7 is another perspective view of the accessory bracket shown in FIG. 4 attached to the cylinder block.

The accessory mounting part 23 has a circular, convex end. A threaded hole 23*b* is formed in a central part of the accessory mounting surface 23*a* so as to extend into the reinforcing rib 22. The accessory mounting surface 23*a* of the accessory mounting part 23 is provided in a part below the threaded hole 23*b* with a threaded hole 23*c*, as shown in FIG. 7.

A right support arm 24 is formed integrally with the mounting part 21 so as to extend obliquely upward toward the front from an upper right-hand part of the mounting part 21. A left support arm 25 is formed integrally with the reinforcing rib 22 so as to extend from a part of the reinforcing rib 22 slightly to the left from the accessory mounting part 23. The right support arm 24 and the left support arm 25 are provided with coaxial holes 24*a* and 25*b*, respectively.

The accessory bracket 20 is attached to the cylinder block 3. As shown in FIG. 3, a mounting surface 3*a* is formed in a right part of the front surface of the crankcase 3C formed integrally with the cylinder block 3. Four threaded holes 3*b* are formed in upper right and left and lower right and left part of the mounting surface 3*a*, respectively.

A circular recess 3*d* protruding rearward is formed in a space formed on the right side of the front cylinder bank 3F offset to the left. The bottom surface of the circular recess 3*d* extends along the blowby gas passage 7.

Figure 6:
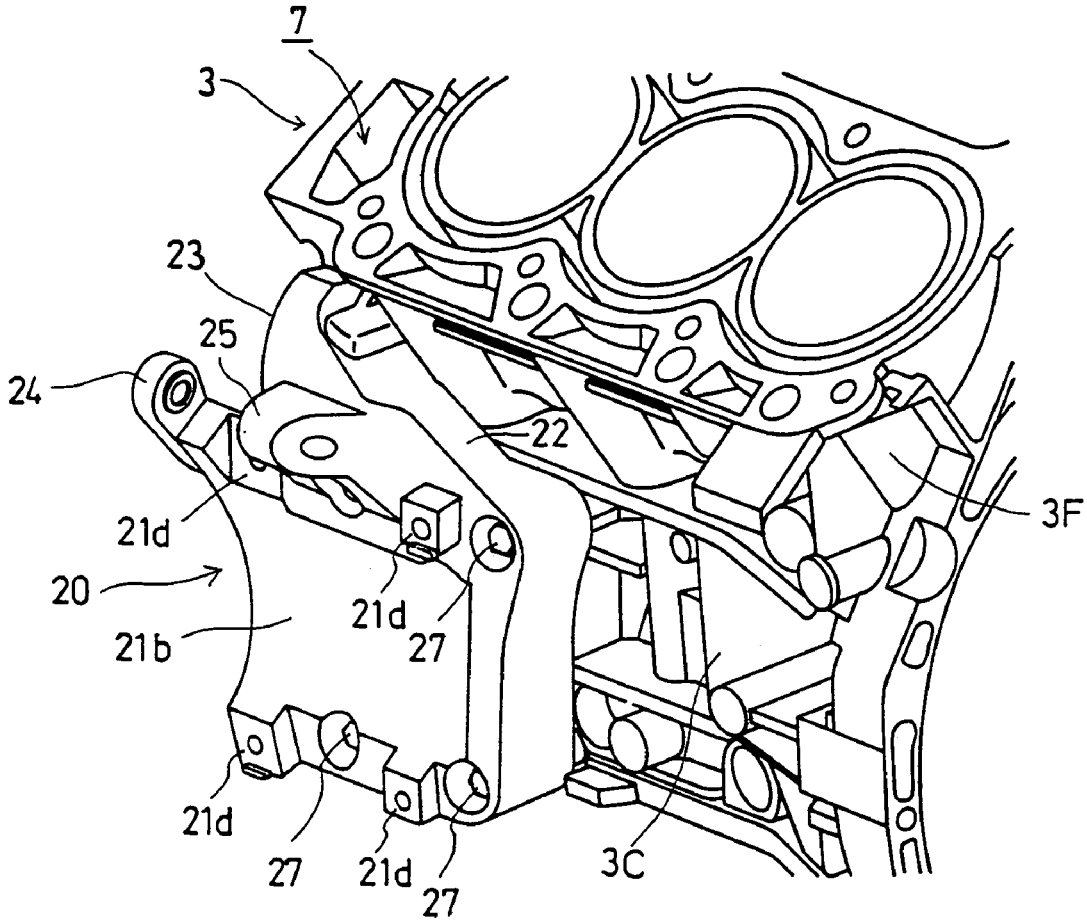
FIG. 6 is a perspective view of the accessory bracket shown in FIG. 4 as attached to the cylinder block.

The accessory bracket 20 is attached to the crankcase 3C formed integrally with the cylinder block 3 with the flat inner surface 21*a* of the attaching part 21 on the mounting surface 3*a* of the crankcase 3C. As shown in FIGS. 6 and 7, the accessory mounting part 23 is inserted in the circular recess 3*d*. Four bolts 27 are inserted in the attaching holes 21*c* of the attaching part 21 of the accessory bracket 20 and are screwed in the threaded holes 3*b* formed in the mounting surface 3*a* of the cylinder block 3 to fasten the accessory bracket 20 to the cylinder block 3. When the accessory bracket 20 is thus fastened to the front surface of the cylinder block 3, a circular back part of the accessory mounting part 23 is sunk in the recess 3*d*, and the accessory mounting surface 23*a* faces rightward.

Figure 8:
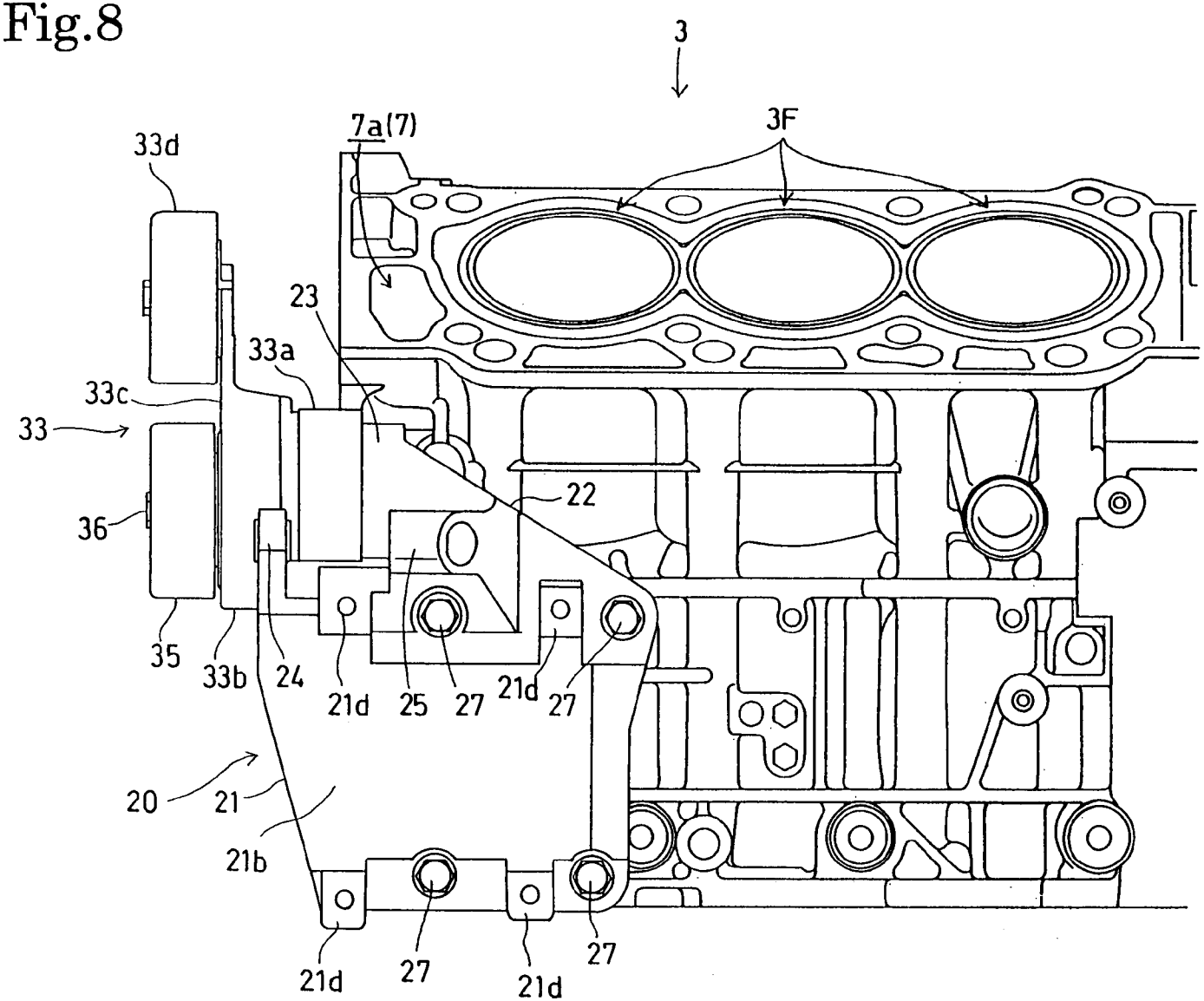
FIG. 8 is a front elevation of the accessory bracket attached to the cylinder block and holding an automatic tensioning device thereon.
Figure 9:
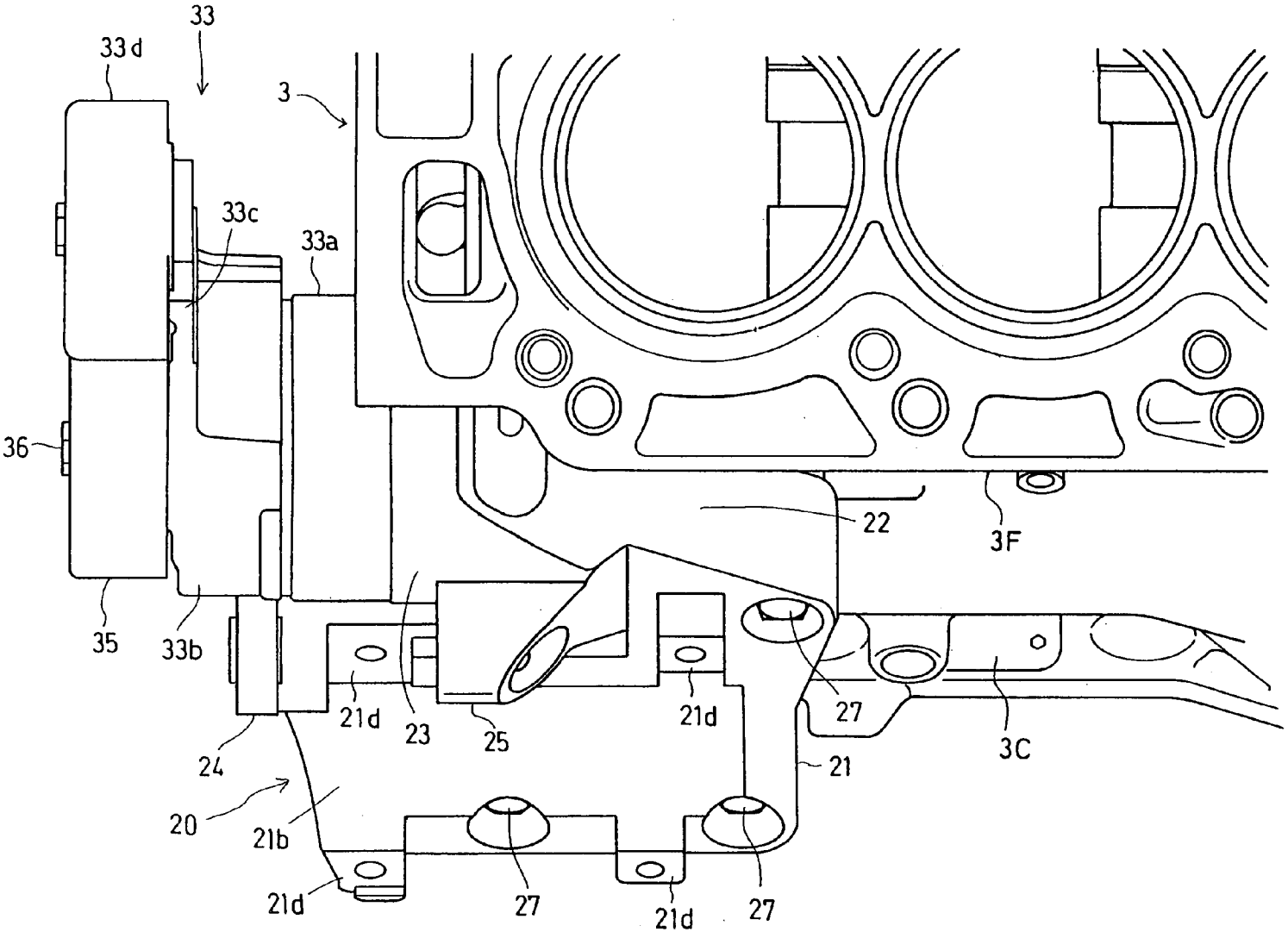
FIG. 9 is a plan view of the accessory bracket attached to the cylinder block and holding the automatic tensioning device thereon.

The automatic tensioning device 33 is mounted on the accessory mounting surface 23*a*. As shown in FIGS. 8 and 9, the automatic tensioning device 33 has a stationary cylindrical member 33*a*, a turning cylindrical member 33*b* disposed coaxially with the stationary cylindrical member 33*a*, a torsion spring urging the turning cylindrical member 33*b* in a clockwise direction, as viewed in FIG. 1, the swing arm 33*c* coaxially with the turning axis of the swing arm 33*c* radially extending from the turning cylindrical member 33*b*, the idler pulley 35 supported for rotation on the base end of the swing arm 33*c*, and the idler pulley 33*d* supported for rotation on the free end of the swing arm 33*c*.

A bolt 36 is extended through central parts of the stationary cylindrical member 33*a*, the turning cylindrical member 33*b* and the idler pulley 35 of the automatic tensioning device 33 and is screwed in the threaded hole 23*b* of the accessory mounting part 23 of the accessory bracket 20 to mount the automatic tensioning device 33 from the right side on the accessory bracket 20.

The reinforcing rib 22 extends behind the accessory mounting part 23 of the accessory bracket 20 in the direction of extension of the bolt 36. The reinforcing rib 22 connects the accessory mounting part 23 to a part fastened to the cylinder block 3 with one of the bolts 27 as shown in FIG. 8. Thus, the accessory mounting part 23 and the accessory bracket 20 are sufficiently rigid, the vibration of the accessory mounting part 23 and the accessory bracket 20 can be suppressed, the continuously loaded automatic tensioning device 33 is held firmly and the engine body is protected.

Figure 10:
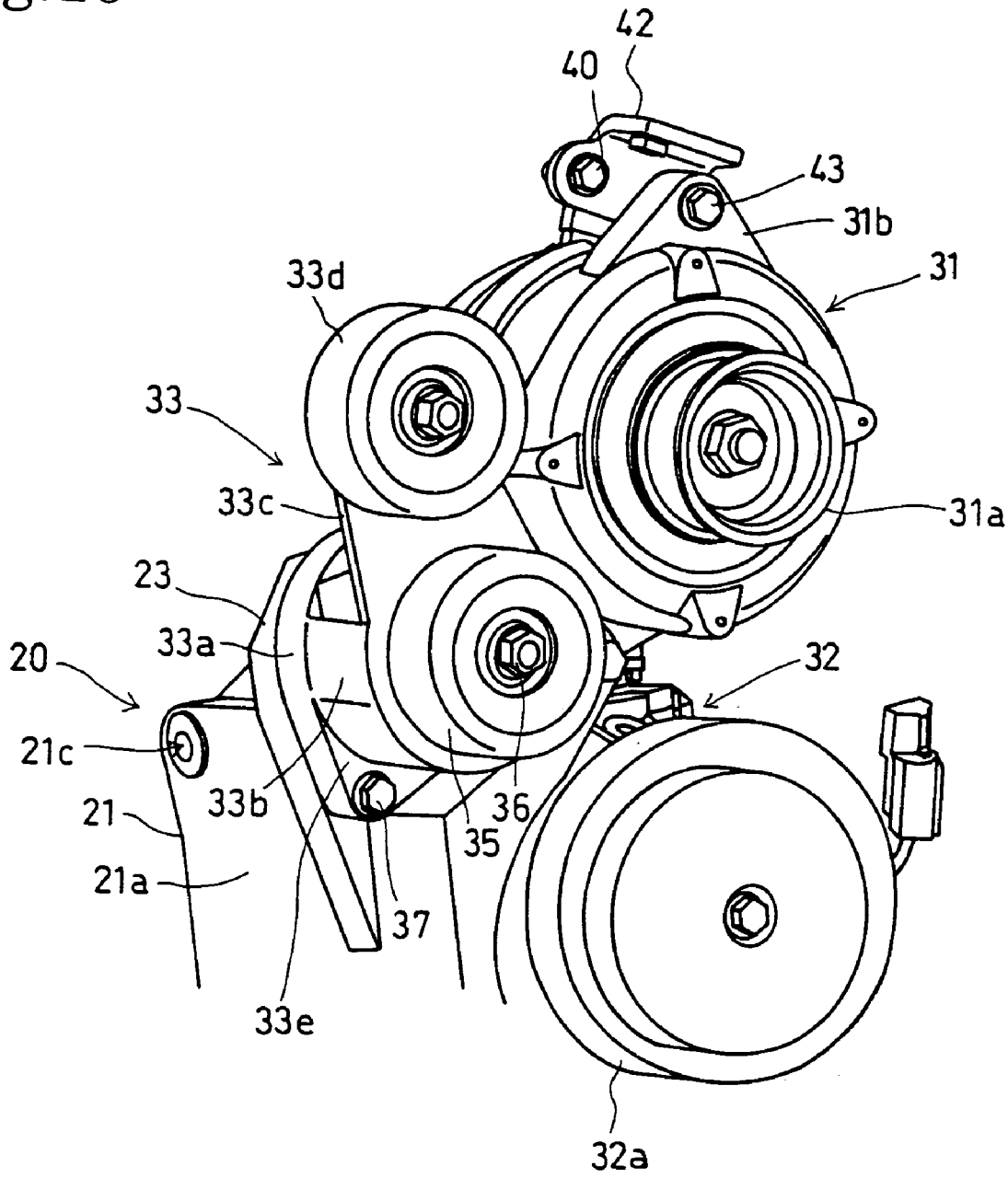
FIG. 10 is a perspective view of the accessory bracket holding an automatic tensioning device, an air compressor and an alternator.

As shown in FIG. 10, a part of the stationary cylindrical member 33*a* is projected downward to form a fixing part 33*e* provided with a bolt hole. A bolt 37 is inserted in the bolt hole of the fixing part 33*e* and is screwed in the threaded hole 23*c* of the accessory mounting part 23 of the accessory bracket 20 to restrain the stationary cylindrical member 33*a* of the automatic tensioning device 33 from turning.

As shown in FIG. 1, the timing belt cover 10 is disposed in a space between the swing arm 33*c* of the automatic tensioning device 33, and the right side surface of the cylinder block 3.

A part of the air compressor 32 is placed in the outer surface 21*b* provided with a cylindrical recess of the attaching part 21 of the accessory bracket 20, and is fastened to the attaching part 21 with bolts screwed in the threaded holes of the four mounting bosses 21*d*.

The alternator 31 has an upper attaching lug 31*b* and a lower attaching lug 31*b*. As shown in FIG. 1, the lower attaching lug 31*b* is placed between and fastened with a bolt 40 to the right support arm 24 and the left support arm 25 projecting from upper parts of the accessory bracket 20.

As shown in FIGS. 1 and 10, the upper attaching lug 31*b* of the alternator 31 is fastened to a bracket 42 having a base end part fastened with a bolt 40 to the front cylinder head 4F with a bolt 43 to hold the alternator 31 on the engine body.

The endless accessory driving belt 30 is extended around those pulleys 31*a*, 32*a*, 33*d* and 35 of the automatic tensioning device 33, the air compressor 32 and the alternator 31 thus held on the accessory bracket 20.

The accessory bracket 20 is attached directly to the cylinder block 3 with the accessory mounting part 23 partly sunk in the recess 3*d* formed in a space on the right side of the front cylinder bank 3F offset to the left and extending along the blowby gas passage 7. Since the accessory bracket 20 is fixed to the cylinder block 3 so as to overlap the cylinder block 3, the accessory driving belt 30 can be extended near the engine body, the internal combustion engine can be formed in a short overall length and in compact construction.

What is claimed is:

1. An accessory mounting structure for an internal combustion engine containing cylinders in a V-arrangement containing two banks of said cylinders, comprising:

a blowby gas passage provided in an end part of only one of said cylinder banks of an engine body, with respect to a direction parallel to a crankshaft, said end part arranged outside of the V-arrangement of the cylinders;

a part of the engine body provided with a recess extending only along the blowby gas passage and ending prior to a first cylinder of said only one of said cylinder banks; and an accessory bracket partly sunk in the recess and fastened to the engine body, for holding at least one accessory thereon.

2. The accessory mounting structure according to claim 1, wherein the accessory bracket has an accessory mounting part, and a reinforcing rib extending from the accessory mounting part.

3. The accessory mounting structure according to claim 2, wherein the reinforcing rib connects at least one of attaching parts of the accessory bracket, to be fastened to an engine body included in the internal combustion engine to attach the accessory bracket to the engine body, and the accessory support part.

4. The accessory mounting structure according to claim 1, wherein the accessory held by the accessory support structure is an automatic tensioning device.

5. The accessory mounting structure according to claim 1, wherein the accessory mounting part of the accessory bracket is a convex part protruding toward the engine body, and the convex part is placed in the recess formed in the engine body.

6. The accessory mounting structure according to claim 5, wherein the accessory mounting part is provided with an accessory mounting seat on its side surface.

7. The accessory mounting structure according to claim 1, wherein the accessory bracket has an attaching part to be attached to the engine body, and the attaching part of the accessory bracket is fastened to the engine body by fastening means.

8. The accessory mounting structure according to claim 7, wherein a back surface of the attaching part to be fastened to the engine body is flat, and a front surface opposite to the back surface of the mounting seat is provided with a recess.

9. The accessory mounting structure according to claim 1, wherein the accessory bracket is provided with a holding arms for holding another accessory.

10. An accessory mounting structure for an internal combustion engine having first and second cylinder banks arranged in a V-arrangement, and a crankcase commonly shared by the first and second cylinder banks, said crankcase containing a crankshaft therein, wherein cylinders of one cylinder bank are offset to cylinders of the other cylinder banks in the direction of said crankshaft in such a manner that only said one cylinder bank has an end part between an end wall of the one cylinder bank and a first cylinder adjacent to said end wall, which is formed with a blowby gas passage therethrough, and wherein said end part has a recess extending along said blowby gas passage, said recess being formed at a side of said only one cylinder bank opposite an intermediate space between the first and second cylinder banks and ending prior to said first cylinder of said one cylinder bank, and an accessory bracket is fastened to said only one cylinder bank in such a manner that the accessory bracket is partly sunk in said recess.

11. The accessory mounting structure according to claim 10, wherein said accessory bracket has an accessory mounting part, and a reinforcing rib extending from the accessory mounting part.

12. The accessory mounting structure according to claim 11, wherein said accessory mounting part has an accessory mounting seat on a side surface thereof.

* * * * *